United States Patent [19]

Wall

[11] Patent Number: 4,879,939

[45] Date of Patent: Nov. 14, 1989

[54] ACTION FOR UPRIGHT PIANO

[76] Inventor: Paul G. Wall, 4-60 Centreville Road, Kitchener, Ontario N2A 1R9, Canada

[21] Appl. No.: 171,741

[22] Filed: Mar. 22, 1988

Related U.S. Application Data

[63] Continuation-in-part of Ser. No. 904,114, Sep. 4, 1986, abandoned.

[51] Int. Cl.[4] ..... G10C 3/18

[52] U.S. Cl. ..... 84/240

[58] Field of Search ..... 84/236-242, 84/247-249, 255, 216-219

[56] References Cited

U.S. PATENT DOCUMENTS

| | | | |
|---|---|---|---|
| 135,820 | 2/1873 | Kühner | 84/240 |
| 242,732 | 6/1881 | Woodward | 84/240 |
| 473,944 | 5/1892 | Merkel | 84/240 |
| 478,323 | 7/1892 | George | 84/236 X |
| 481,121 | 8/1892 | Richardson et al. | 84/218 |
| 608,177 | 8/1898 | Cobb | 84/219 |
| 896,763 | 8/1908 | Schimmel | 84/239 X |
| 904,117 | 11/1908 | Cross | 84/241 |

FOREIGN PATENT DOCUMENTS

| | | | |
|---|---|---|---|
| 4364 | of 1902 | United Kingdom . | |
| 332328 | 7/1930 | United Kingdom | 84/240 |

*Primary Examiner*—L. T. Hix
*Assistant Examiner*—Brian W. Brown
*Attorney, Agent, or Firm*—R. Craig Armstrong

[57] ABSTRACT

An action for an upright piano which emulates or simulates the action of a grand piano is provided. In the action, a back check lever is positioned above the back of the key, and a grand piano whippen is positioned above the back check lever. The grand whippen acts on a knuckle provided on a catcher arm integrally connected with the hammer shank at a substantial angle. Depression of the key produces upward movement of the back of the key, the back check lever, and the grand whippen, in turn producing rotation of the catcher arm which drives the hammer towards the string. The catcher arm has a catcher at its forward end and the back check lever has a back check for catching the catcher after the hammer has rebounded from the string. A vertically-acting gravity-activated damping action is provided. The hammer action is mounted independently from the damping action, and a shifting lever connected to a foot pedal permits lateral shifting of the hammer action with respect to the strings. A hammer return spring is positioned between a hammer spring rail and the hammer shank to bias the hammer away from the string.

12 Claims, 4 Drawing Sheets

ACTION FOR UPRIGHT PIANO

REFERENCE TO RELATED APPLICATION

This is a continuation-in-part of application Ser. No. 06/904,114, filed Sept. 4, 1986, now abandoned.

BACKGROUND OF THE INVENTION (1) Field of the Invention

This invention relates to an action for an upright piano, the action being the mechanism which transmits to the piano strings the impetus given by the player's touch.

An ideal piano action would have the following characteristics: Firstly, the piano player should have good control over the hammer blow, in order to be able to vary the character of the notes played. Secondly, there must be escapement so that the hammer can rebound freely after striking the string, even if the key is still being depressed by the player. Thirdly, the motion of the hammer should be checked after it has rebounded from the string. Fourthly, the player should be able to repeat the note immediately and continuously if desired, even if the key is not fully released. Fifthly, the damping action should be instantaneous and silent.

Different piano actions approach these ideals to varying degrees. The action of a grand piano is generally considered to much more closely approach these ideals than the action of an upright piano. For example, the grand piano action allows for immediate and continued repetition of a note, even if the key has not fully returned to its normal (undepressed) position, while the upright action requires that the key return to or almost to its normal position before the note can be repeated. This difference is due to the superior design of the grand piano whippen assembly.

The conventional upright piano action has a single simple escapement, that of the hammer from the jack of the whippen assembly. The head of the jack is ordinarily in contact with the butt of the hammer. When the key is depressed the jack is moved upwardly, forcing the butt of the hammer to rotate upwardly about the pivot point on its flange. At a certain point before the hammer contacts the string, escapement takes place. The jack rotates out from under the butt of the hammer, freeing the hammer to continue under its own inertia towards the string and to rebound freely after impact. After rebounding from the string, the catcher is caught by the backcheck and held in this position as long as the key is depressed. In order for the note to be repeated, the key must be fully released or very nearly so, so that the jack can drop back into position under the hammer butt.

By contrast, in the grand piano action the jack can drop back under the knuckle before the key is fully released. In a grand piano action, there is a compound escapement, involving the jack coming into contact with a regulating button and being forced to rotate out from under the knuckle of the hammer, and also the repetition lever coming into contact with a drop screw. As the key is depressed, the escapement takes place and the hammer flies freely towards the string under its own inertia. After rebounding from the string, the catcher is caught by the backcheck and held in this position as long as the key is depressed. Then, when the key is released slightly, the repetition lever supports the knuckle, allowing the jack to drop back into position. Consequently, if the key is depressed again, the jack can immediately move upwards and attack the knuckle. Repeating a note immediately and continuously is thus far easier than on an upright piano.

Checking in a grand piano action must generally be more secure than in an upright action, due to the force in the direction of the string exerted by the repetition lever on the knuckle on the hammer shank.

With respect to damping in a grand piano, the damper is held onto the string by gravity. As soon as the key is released, the damper starts to drop back onto the string. The damper is also under the direct control of the key. When the key is depressed the effect produced by gravity on the damper must be overcome. The fact that the damper is under direct control of the key and that the damper is held on the string only by gravity gives the grand piano a precise touch which is appreciated by many players.

By contrast, the damper in the upright piano is held onto the string by means of a small damper spring. When the key is depressed the force exerted by the spring on the damper must be overcome. Overcoming this force is a gradual process and the touch of the upright piano keys is consequently somewhat different from that of the grand piano. The spring may also deteriorate with time and thereby produce an inconsistent touch. If sufficient deterioration occurs, the damper may be left in imperfect contact with the string, thereby reducing its ability to dampen string vibration. Also, the damper is not under the direct control of the key but rather is activated via an intermediate lever. These factors result in a damper action which has a less controlled and consistent touch and which is more prone to mechanical problems than the damper action in a grand piano.

In addition to superior note repetition, the grand piano action has an advantage over the upright piano action in relation to the operation of the left or soft pedal, largely due to the fact that the hammer and damper actions are structurally independent of each other.

In the grand piano, when the left pedal is depressed, the key frame slides laterally on the key bed. The hammer action is attached to the key frame, and consequently it also slides laterally when the soft pedal is deprssed. If a key in the treble section is played, the hammer ordinarily strikes three strings. However, if the key is played while the soft pedal is being depressed, the hammer will move laterally with the key frame and strike only two strings. A softer sound will consequently be produced.

In a conventional upright piano, movement of the key frame is generally not possible, because the dampers are attached to the main action rail, as are the hammer flanges. An exception is shown in U.S. Pat. No. 608,177 (Cobb), but the structure in that case is impractical for a variety of reasons, and the damping arrangement is different from in the present invention.

Since the dampers must not move in relation to the strings (because they must be seated properly on the strings in order to dampen string vibration), this means that the hammer action, being supported on the same main action rail, cannot move with respect to the strings. By contrast, in the grand piano, the dampers are attached to a damper flange rail which is independent from the main action rail. The key frame can therefore be made free to move laterally when the soft pedal is used, without having the dampers shift.

In a conventional upright piano, softening is achieved by having the hammer rail move the hammers closer to the strings when the soft pedal is depressed. If a key is played with the soft pedal depressed, some of the motion normally imparted to the hammer is lost because of the shorter distance between the hammers and the strings and because of the shorter period of contact between the jack and the hammer butt resulting from the shifting of the hammer rail, so the hammer strikes the strings with less force than normal. A hammer in the treble section of the piano will normally strike three strings, but will strike them with less force than usual when the soft pedal is used, and will therefore produce a softer sound.

(2) Description of the Prior Art

U.S. Pat. No. 608,177 (Cobb), mentioned above, shows lateral shifting of the keyboard and action in response to the soft pedal, but is impractical in its actual structure. The hammer rail and the key frame shift laterally, but via separate actuation rather than being connected together as a unit.

U.S. Pat. Nos. 332,328 (Hofmann) and 473,944 (Merkel), show hammer actions similar to the one of the present invention, but their damping mechanisms renders them impractical because of space limitations. Also, there is no independence of the hammer action and the damping action in either patent.

United Kingdom Pat. No. 4364/1901 (Midgley), shows a gravity-biased vertical-motion damping mechanism actuated by the back of each key, but it is structurally different from the damping mechanism in the present invention, and the dampers are located above instead of below the hammers.

U.S. Pat. No. 481,121 (Richardson et al), shows a vertically-oriented damper lifter, but for a pianoforte with horizontal rather than upright strings.

U.S. Pat. Nos. 135,820 (Kuhner) and No. 904,177 (Cross), show dampers actuated by the back of the key, without direct linkage, but are otherwise irrelevant.

SUMMARY OF THE INVENTION

It is an object of the present invention to provide an action for an upright piano which emulates or simulates the grand piano action. The action allows notes to be repeated even when the key has not fully returned to its normal position, and because the hammer action and the damper action are independent, allows the key frame to move laterally when the soft pedal is depressed.

In the action of the present invention, the conventional upright piano whippen and hammer butt have been replaced with ones such as those in the grand piano. This allows for immediate and continued repetition of notes. Unlike in the Hofmann action, the damper and hammer of the present action are not located on the same action rail, but rather are set up independently on their own action rails. This independent structure allows for several advantages. Firstly, the dampers may be arranged in such a manner as to be activated by gravity, as is the case in a grand piano, and not by means of a spring, as is usually the case in an upright piano. Secondly, the key frame and hammer action can be allowed to slide laterally on the key bed when the soft pedal is deprssed, without moving the dampers, thereby allowing for the action of a true soft pedal.

The action allows the upright piano to play very much as if it were a grand piano, having a touch similar or identical to that of a grand piano. The action is arranged in such a manner as to fit easily into the compact size and shape of the upright piano.

Additional features of the invention will be described or will become apparent in the course of the following detailed description of the preferred embodiment of the invention.

BRIEF DESCRIPTION OF THE DRAWING

The preferred embodiment of the invention will now be described with reference to the accompanying drawings, in which.

DETAILED DESCRIPTION OF THE PREFERRED EMBODIMENT

Figure 1:
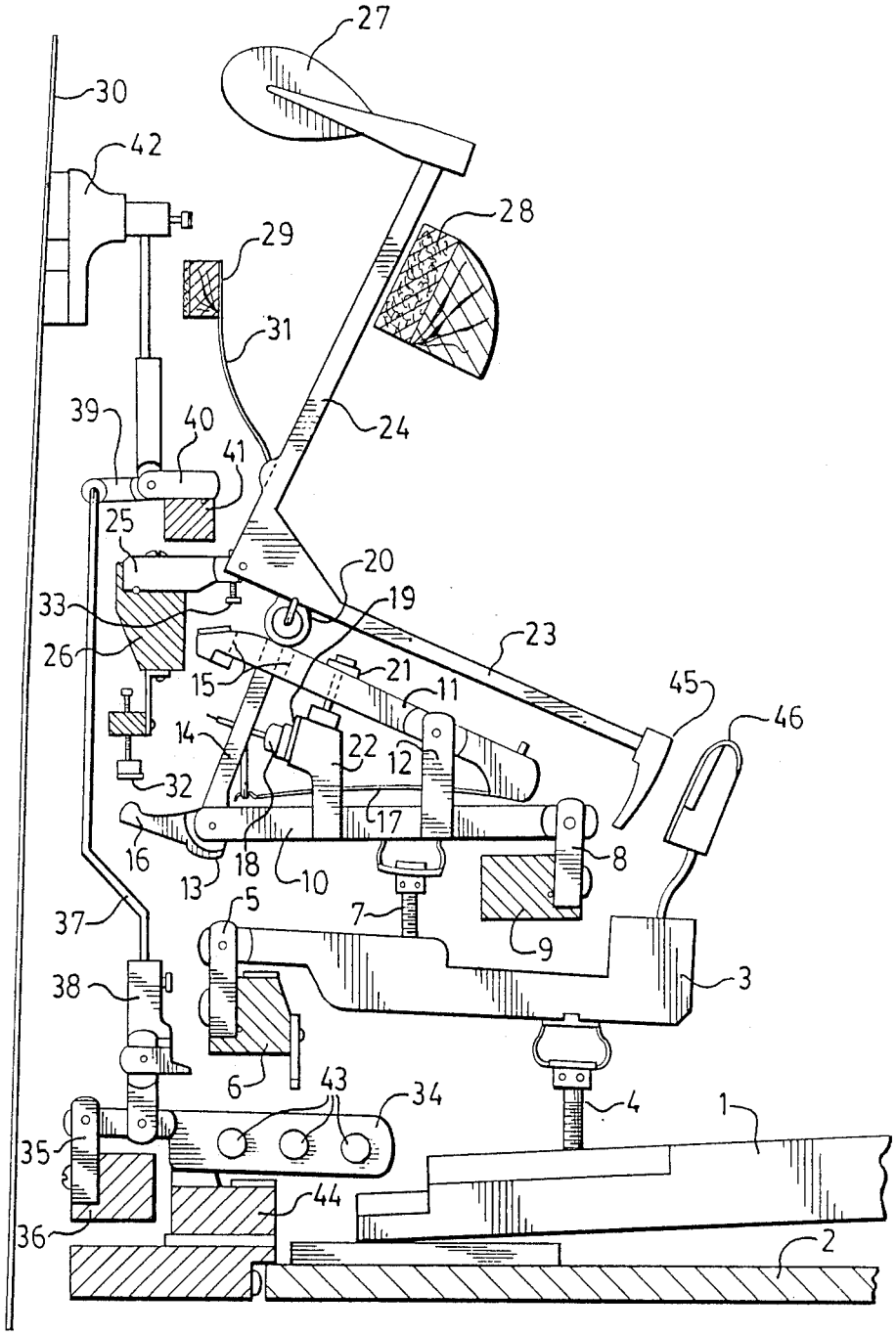
FIG. 1 is a side view of one note element of the action, showing it in the unactuated position.

The structure and operation of the action are as follows, described with reference to FIG. 1.

The player depresses the front of the key (not shown), which raises the back of the key 1, the key being installed in the usual lever fashion on the key frame 2. The upward movement of the back of the key 1 raises the back check lever 3 via capstan screw 4 causing it to rotate about its flange 5, installed on a backcheck lever rail 6. The upward movement of the back check lever 3 lifts capstan screw 7, causing the whippen assembly to move upwardly, rotating in about its flange 8 which is attached to the whippen rail 9.

The whippen assembly is essentially that of a grand piano, comprising a whippen arm 10 pivotally connected near its front end to a flange 8 on whippen rail 9, a repetition lever 11 pivotally connected to a repetition lever flange 12 protruding upwardly from an intermediate point of the whippen arm 10; a jack 13 pivotally connected to the whippen arm 10 near the rear end of the whippen arm, the jack comprising an upwardly-directed attack arm 14 passing through a slot 15 provided in the repetition lever 11 and a rearwardly-directed bell-crank arm 16 integral with the attack arm 14. A repetition lever spring 17 biases a jack regulating button 18 on the attack arm 14 forwardly against a stop 19 for positioning the end of the attack arm 14 directly under the knuckle 20, and at the same time biases the repetition lever 11 upwardly against a felt pad on repetition lever screw 21 such that the repetition lever 11 is prevented from ordinarily lying below the end of the attack arm 14 in the area of the knuckle 20. The stop 19 and the repetition lever screw 21 are both carried on a stop support arm 22.

The upward movement of the whippen assembly produced by depressing the key 1 causes the jack 13 to move upwards so that its attack arm 14 "attacks" the knuckle 20 on the catcher arm 23. The attack on the knuckle 20 causes the catcher arm 23 and integral hammer shank 24 to rotate about the hammer flange 25 installed on main action rail 26, thereby urging the hammer 27 away from its resting position near the hammer rail 28, towards the string 30. The hammer 27 is ordinarily assisted to its resting position by a hammer return spring 31 between the hammer shank 24 and spring rail 29.

One improvement on the prior art is the addition of hammer return spring 31. Without such a spring, an action such as the one in the above-mentioned Hofmann patent cannot function properly or cannot function well. The hammer return spring 31 makes this type of action functional. A heavy counterweight on the catcher arm or the catcher itself, such as shown in the above-mentioned Merkel patent is not sufficient to counter the weight transfer of the hammer as it rotates over the hammer flange 25 and nears the string, and is also undesireable since such a weight would place too much of a load on the repetition lever 11 and attack arm 14. This weight transfer must be compensated for, but is gradual as the hammer moves towards the string. A string fulfills this function because as it is compressed it offers gradually-increasing resistance, thus compensating effectively for the weight transfer without adding mass to the catcher arm.

This spring 31 also aids the hammer to return to its resting position and counters the upward force exerted by the repetition lever spring 17 on the knuckle 20 when the hammer is released from the check position.

Just before the hammer 27 hits the string 30, the bell-crank arm 16 of the jack 13 comes into contact with the regulating button 32 attached underneath main action rail 26. The regulating button 32 causes the jack 13 to rotate counter-clockwise (with respect to the viewpoint used in the drawings), so that the attack arm 14 moves rearwardly (i.e. generally away from the front of the piano and towards the string 30) and away from underneath the knuckle 20. At essentially the same time, the rearward end of repetition lever 11 comes into contact with the drop screw 33 installed in hammer flange 25. The drop screw 33 prevents any further upward movement of the repetition lever 11. Thus the drop screw 33 and the regulating button 32 control the compound escapement of the hammer assembly from the repetition lever 11 and attack arm 14 respectively. When this escapement occurrs, the hammer 27 flies freely towards the string 30.

Figure 2:
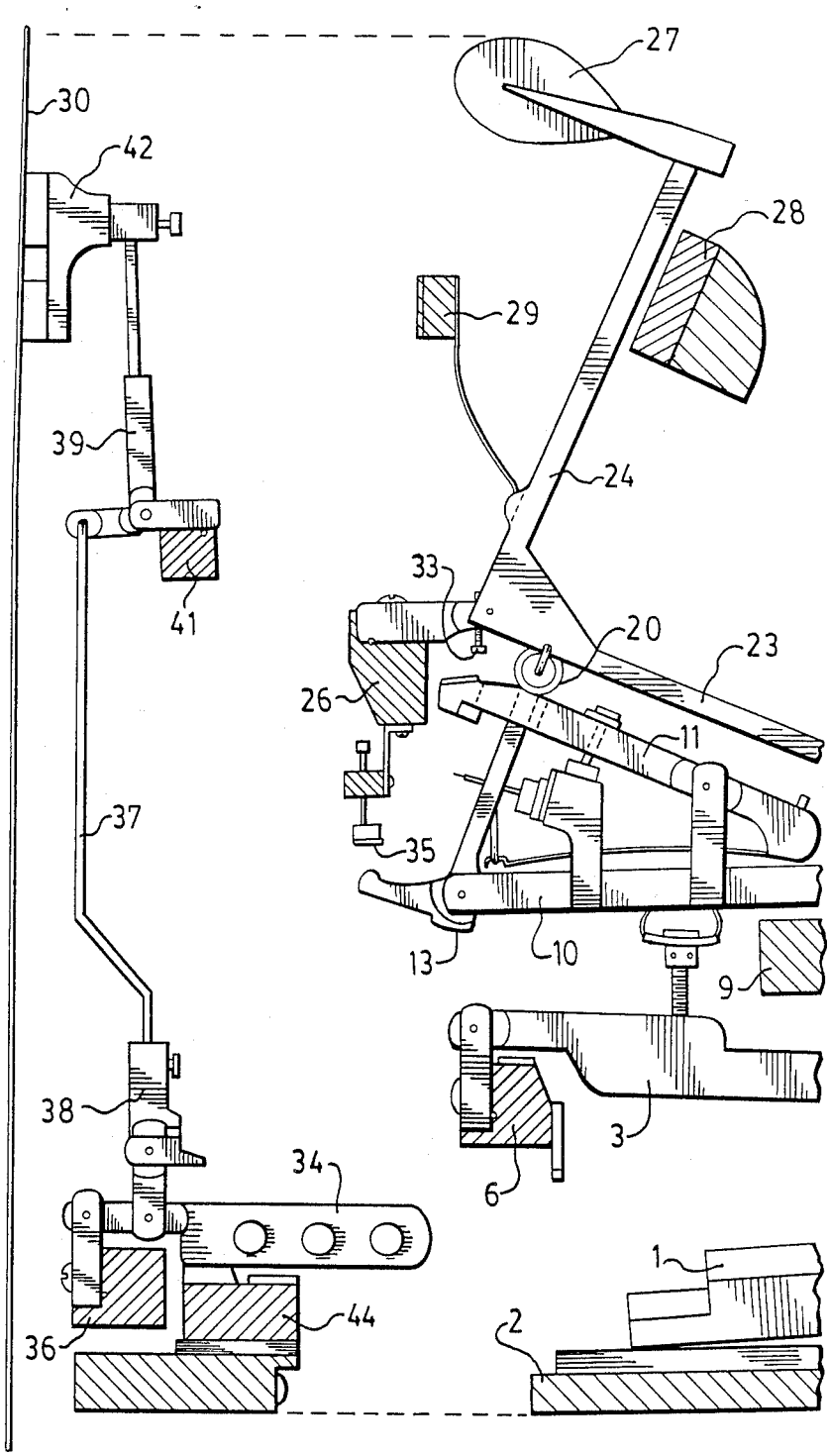
FIG. 2 is a view corresponding to FIG. 1, exploded to show the independence of the hammer action and the damper action.

The damping action will now be described. As can be seen clearly from FIG. 2, the damping action is independent of the hammer action, and is under direct control of the back of the key 1. As the key 1 is depressed, the rising back end of the key 1 comes into contact with the damper lever 34, which is pivotally installed on flange 35 mounted on lower damper lever rail 36. The resulting upward rotation of the damper lever 34 lifts the damper wire 37 connected to the damper lifter flange 38, ultimately causing the upper damper lever 39 to rotate about its flange 40 installed on the upper damper lever rail 41. This rotation causes the damper 42 to be lifted off the string 30. Lead weights 43 in the damper lever 34 cause the damper 42 to return to the string 30 as the key 1 starts returning to its resting position. The right pedal lifts all of the dampers 42 from the strings 30 by acting to lift the damper lift rail 44 which raises the damper lever 34.

An improvement on the prior art is that this damper action is functional and compatible with a Hofmann-type hammer action. The damper action disclosed in the Hofmann patent is not practical because it occupies too much space.

The shortage of space between the hammer rail 26 and the strings 30 dictates a damper mechanism that functions within this small space. This shortage of space becomes even more critical in the bass section where the bass strings cross over the treble strings thus decreasing the space between the strings and damper action considerably (in a model of the present invention, there is a distance of 12 mm. between the string and the upper damper lever 39—the bass strings cross over the treble strings usually 10 mm. over them. That leaves just 2 mm. of clearance between the upper damper lever 39 and the bass strings. This 2 mm. is not sufficient space for a standard upright damper lever to function in, such as found in the Hofmann, Merkel, Cross, Kuhner, Cob actions.

The damper action of the present invention is compatible with the limitations of space in which it must function, primarily because there is no movement of the damper mechanism in a direction towards the strings when it is activated. It can therefore be positioned 2 mm. from the bass strings with no danger of interference with the strings during playing. Damper actions such as those referred to above have a movement of the lever that nears the string during playing. The Midgley damper action is an exception, though it is unsuitable in other respects, as will now be discussed.

In the present invention, the damper is gravity activated, but is seated against the string below the hammers. The Midgley damper mechanism is gravity-biased and each damper is actuated by the back of each key, as is the case in the present invention. In the present invention, however, these two characteristics are applied to a damper which is seated below the hammer. Locating the damper above the hammer is undesireable in terms of performance, because the damper is then located too close to the strings' termination point. In the present invention, the dampers are positioned below the hammers, where the amplitude of the string is greater and the damper functions better accordingly. In the present invention, there is therefore a damper action which functions below the hammer and yet is still gravity biased and controlled by the back of the key.

When the hammer 27 strikes the string 30 and rebounds, being free to do so by virtue of the escapement, the rebounding knuckle 20 lands on the repetition lever 11. Since the downward force of the rebounding hammer is greater than the force of the repetition lever spring 17, the knuckle 20 pushes the repetition lever 11 down, causing it to pivot about its flange 12. The downward motion continues until the motion of the hammer 27 is checked when the catcher 45 falls into the back check 46, which is moved into position by virtue of the raising of the back check lever 3. As in a grand action, the checking is quite secure, which is necessary because of the presence of the repetition lever. The hammer remains in the checked position as long as the key 1 is depressed.

At this point the key 1 is fully depressed, the repetition lever 11 is slightly depressed away from repetition lever screw 21 and is exerting upward pressure on the knuckle 20 by virtue of the upward force which the spring 17 exerts on the repetition lever 11. As long as the key remains depressed, the upward force of the repetition lever spring tries to push the knuckle 20 up, but cannot because the hammer is held in check. However, as soon as the key 1 is slightly released and starts to come up, the back check 46 releases the catcher 45, and the upward force exerted by the repetition lever 11 on the knuckle 20 acts to support the knuckle 20 briefly, allowing the attack arm 14 of the jack 13 to return to its starting position under the knuckle 20 as soon as it is clear of the regulating button 32. This immediate repositioning of the attack arm 14 of the jack 13 allows for immediate and continued repetition of the note if desired, without need for the key 1 to be fully released.

When the soft pedal (not shown) is depressed, the key frame 2 and hammer action, including the backcheck lever rail 6, the whippen rail 9, main action rail 26, and spring rail 29, slide laterally on the key bed 49. If the key 1 is depressed while the soft pedal is depressed, the hammer 27 thus strikes fewer strings than usual, thereby producing a softer sound.

This is possible because as in a grand piano, the damper action is completely independent of the hammer action (as shown clearly in FIG. 2), so that the key frame 2 and the hammer action can be move laterally without affecting the damping mechanism.

Figure 3:
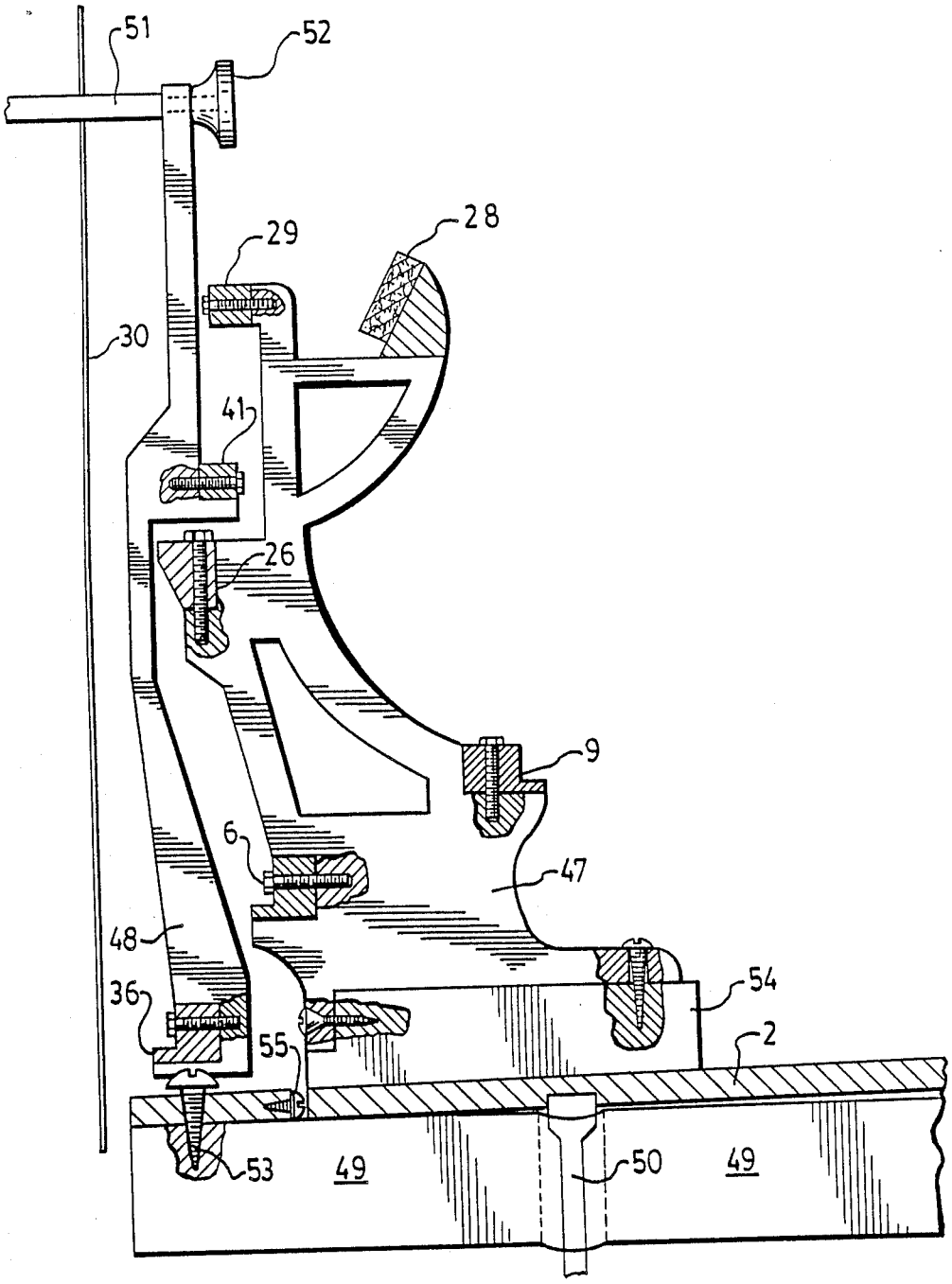
FIG. 3 is a side view showing the action brackets and rails to furthher clarify the independence of the hammer action and the damper action and to illustrate how the hammer action can be shifted laterally.

FIG. 3 further clarifies the independence of the damper and hammer actions and shows how the hammer action is shifted laterally.

The hammer action flange rails 26, 9, 6 are secured in their proper locations relative to each other by an action bracket 47. This bracket, traditionally made of cast iron, also secures the spring rail 29 and the hammer rest rail 28. This action bracket is secured to the bracket support block 54 by two screws. The bracket support block 54 is glued and screwed to the key frame 2. Since the key frame also supports all of the keys it becomes one unit with the hammer action.

The key frame 2 rests on the key bed 49 and is free to slide laterally on it.

Figure 4:
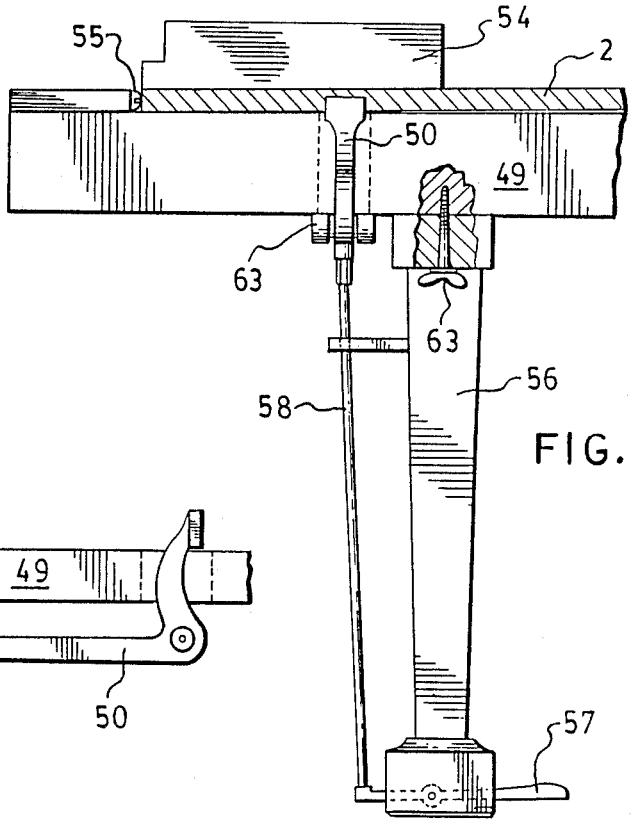
FIG. 4 is a side view corresponding to FIG. 3, but showing the lower structural elements of the piano.
Figure 5:
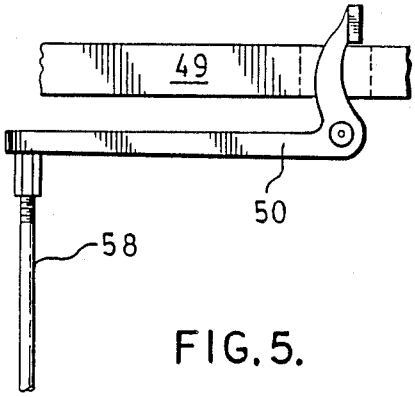
FIG. 5 is a front view showing the keyframe shifting lever.
Figure 6:
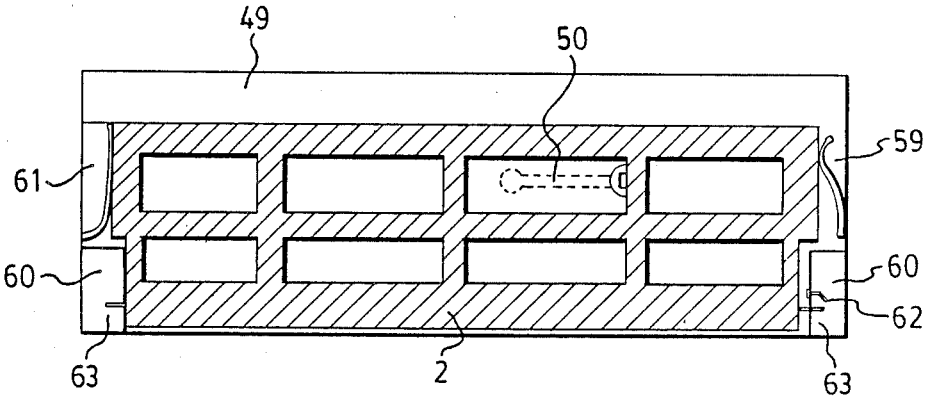
FIG. 6 is a top view showing the keyframe on the keyboard.

As seen best in FIGS. 4, 5 and 6, the movement of the keyframe 2 and therefore the hammer action is actuated by a shifting lever 50 which is actuated by a foot pedal 57 located at the bottom of the pedal lyre 56. This pedal lyre is attached to the bottom of the keybed 49 with large screws 63.

The foot pedal 57 is directly linked to the shifting lever 50 by a pedal rod 58. Pressing the foot pedal 57 down raises the pedal rod 58 and the horizontal arm of the shifting lever 50. The shifting lever 50 rotates in the shifting lever blocks 63 and engages the keyframe 2 which in turn produces a lateral shifting, usually to the right, just enough so the treble hammers hit only two of their three strings, thus reducing the volume of sound.

A screw 62 beside the treble key block 60 engages the side of the keyframe 2 when it has shifted far enough. This movement of the keyframe to the right compresses the keyframe shift spring 59. When the foot pedal is released, the keyframe returns to its original position against a keyframe stop block 61 by virtue of the keyframe shift spring 59.

The lateral movement of the keyframe is also guided by two keyframe guide pins 63 located on each side of the keyframe, which slide into the side of the key blocks 60.

These structural elements relating to the shifting of the keyframe are standard in grand pianos, and are not in themselves inventive.

Therefore when the soft pedal is activated the key frame 2 with keys, action brackets and all parts secured to the action rails move laterally relative to the strings.

The damper action consists of a damper action bracket 48 securing flange rails 41 and 36 in their proper locations relative to each other.

The bottom of the damper action bracket 48 rests on a bracket support screw 53 while the top of the bracket is secured by a nose bolt 51 and a nut 52 in the same manner as all vertical actions.

This renders the damper mechanism secure and immovable during playing. However, it can be removed from the piano by releasing the nut 52 and removing the hammer action. These two actions are therefore structurally independent and yet function as a unit.

It will be appreciated that there may be minor variations on the above-described structure which would be obvious and which would not depart from the principle of the invention. Such obvious variations are considered to be within the scope of the invention, whether or not expressly described and claimed.

What is claimed is:

1. In an upright piano action in which each note element of the action comprises a substantially horizontal key in the form of a lever pivotally connected to a frame member of the piano such that the back of the key is raised when the front playing portion of the key is depressed, a back check lever pivotally connected to a frame member and positioned above the back of said key to be raised by upward movement of the back of the key, at least one substantially vertically-oriented piano string installed on a frame member, a hammer-carrying shank pivotally installed on a main action rail about a horizontal axis for moving said hammer towards and away from said at least one piano string, and hammer action means arranged between said back check lever and said hammer shank for actuating said hammer in response to the upward movement of said back check lever, the improvement in which said hammer action means for each note element is installed on a key frame of the piano capable of lateral movement with respect to said piano strings, and in which said hammer action means for each note element comprises:

a catcher arm integrally connected with said hammer shank at a substantial angle such that substantially upward movement of said catcher arm produces essentially rearward movement of said hammer towards said piano string, said catcher arm including a knuckle on its lower surface and further including a catcher at its forward end for engagement with a back check provided on said back check lever when said key has been fully depressed and said hammer has rebounded from said piano string;

a grand whippen disposed above said back check lever, said grand whippen comprising: a whippen arm pivotally connected near its front end to a whippen rail; a repetition lever pivotally connected to a pivot support arm protruding upwardly from an intermediate point of said whippen arm; a jack pivotally connected to said whippen arm near the rear end of said whippen arm, said jack comprising an upwardly-directed attack arm passing through a slot provided in said repetition lever and a rearwardly-directed bell-crank arm integral with said attack arm; and spring means for biasing said attack arm of said jack forwardly against a stop for positioning directly under said knuckle and for biasing said repetition lever upwardly and against a stop such that said repetition lever does not ordinarily lie below the end of said attack arm in the area of the knuckle, said stops being attached above said whippen arm;

a regulating button positioned below said main action rail and positioned above said bell-crank arm of said jack for engaging said bell-crank arm just prior to said hammer contacting said piano string; and a drop screw fixed with respect to said main action rail and positioned for engaging said repetition lever just prior to said hammer contacting said piano string.

2. An upright piano action improvement as recited in claim 1, in which said hammer action means for each note element is capable of lateral movement with respect to said piano strings by virtue of said key frame being laterally shiftable on a key bed, the strings and damper action being adjustably fixed in position with respect to said key bed, said hammer action means being laterally shiftable with respect to said key bed by virtue of a shifting lever linked to a foot pedal, said shifting lever engaging said key frame for lateral shifting of said key frame on said key bed.

3. An upright piano action improvement as recited in claim 1, further comprising damping means including a damper lever pivotally connected to a damper lever rail and positioned above the back of said key to be contacted by the rising back of said key when said key is depressed, a vertical damper wire connected to said damper lever to be raised when said damper lever is raised, a damper ordinarily resting on said piano strings, an upper damper lever pivotally installed on an upper damper lever rail connecting said damper wire and said damper for converting said upward movement of said damper wire into movement of said damper forward and away from said strings, said damping means being structurally independent from said hammer action means whereby said hammer action means may move laterally without said damping means being moved laterally.

4. An upright piano action improvement as recited in claim 3, in which said damping means is gravity-biased onto said strings, by virtue of said damper lever being weighted.

5. An upright piano action improvement as recited in claim 3, in which said hammer action means for each note element is capable of lateral movement with respect to said piano strings by virtue of said key frame being laterally shiftable on a key bed, the strings and damper action being adjustably fixed in position with respect to said key bed, said hammer action means being laterally shiftable with respect to said key bed by virtue of a shifting lever linked to a foot pedal, said shifting lever engaging said key frame for lateral shifting of said key frame on said key bed.

6. An upright piano action improvement as recited in claim 4, in which said hammer action means for each note element is capable of lateral movement with respect to said piano strings by virtue of said key frame being laterally shiftable on a key bed, the strings and damper action being adjustably fixed in position with respect to said key bed, said hammer action means being laterally shiftable with respect to said key bed by virtue of a shifting lever linked to a foot pedal, said shifting lever engaging said key frame for lateral shifting of said key frame on said key bed.

7. An upright piano action improvement as recited in claim 1, further comprising a hammer return spring attached to a hammer spring rail connected with said hammer action means, said hammer return spring acting against said hammer shank to bias said hammer shank away from said strings.

8. An upright piano action improvement as recited in claim 2, further comprising a hammer return spring attached to a hammer spring rail connected with said hammer action means, said hammer return spring acting against said hammer shank to bias said hammer shank away from said strings.

9. An upright piano action improvement as recited in claim 3, further comprising a hammer return spring attached to a hammer spring rail connected with said hammer action means, said hammer return spring acting against said hammer shank to bias said hammer shank away from said strings.

10. An upright piano action improvement as recited in claim 4, further comprising a hammer return spring attached to a hammer spring rail connected with said hammer action means, said hammer return spring acting against said hammer shank to bias said hammer shank away from said strings.

11. An upright piano action improvement as recited in claim 5, further comprising a hammer return spring attached to a hammer spring rail connected with said hammer action means, said hammer return spring acting against said hammer shank to bias said hammer shank away from said strings.

12. An upright piano action improvement as recited in claim 6, further comprising a hammer return spring attached to a hammer spring rail connected with said hammer action means, said hammer return spring acting against said hammer shank to bias said hammer shank away from said strings.

* * * * *